US006955344B2

(12) United States Patent
Brass et al.

(10) Patent No.: US 6,955,344 B2
(45) Date of Patent: Oct. 18, 2005

(54) TOOL AND CONNECTOR SYSTEM FOR CLAMPING

(76) Inventors: Robert L. Brass, 45 Calhoun St., Washington, CT (US) 06794; Steven W. Lewis, 120 Washington Ave., Woodbury, CT (US) 06798

( * ) Notice: Subject to any disclaimer, the term of this patent is extended or adjusted under 35 U.S.C. 154(b) by 0 days.

(21) Appl. No.: 10/456,357

(22) Filed: Jun. 5, 2003

(65) Prior Publication Data

US 2003/0234479 A1 Dec. 25, 2003

Related U.S. Application Data

(60) Provisional application No. 60/391,358, filed on Jun. 25, 2002.

(51) Int. Cl.[7] ..... B25B 1/20

(52) U.S. Cl. ..... 269/45; 269/3; 269/4; 269/6; 269/249; 269/143; 269/44; 269/45; 269/95

(58) Field of Search ..... 269/3–4, 6, 43–45, 269/47, 16, 87, 95, 143, 172, 240, 247, 249–250, 257, 269–270

(56) References Cited

U.S. PATENT DOCUMENTS

| | | | | | |
|---|---|---|---|---|---|
| 261,832 | A | * | 8/1882 | Clark | 269/128 |
| 569,057 | A | * | 10/1896 | Rielly | 269/270 |
| 728,450 | A | | 5/1903 | Everett | |
| 789,405 | A | | 5/1905 | Ascher | |
| 812,699 | A | | 2/1906 | Stevens | |
| 1,009,609 | A | | 11/1911 | Wenneberg, Jr. | |
| 1,319,900 | A | | 10/1919 | Reeder | |
| 1,352,647 | A | | 9/1920 | Benton | |
| 1,375,686 | A | | 4/1921 | Felton | |
| 1,408,301 | A | | 2/1922 | Jeter | |
| 1,410,184 | A | | 3/1922 | Hunter | |
| 1,497,862 | A | | 6/1924 | Lund | |
| 1,658,436 | A | * | 2/1928 | Greathead et al. | 269/249 |
| 2,366,350 | A | | 1/1945 | Ostling | |
| 2,425,935 | A | * | 8/1947 | Hayman | 174/135 |
| 2,581,978 | A | * | 1/1952 | Spring | 269/219 |
| 2,606,583 | A | | 8/1952 | O'Connor | |
| 2,642,905 | A | | 6/1953 | Hewat | |
| 3,033,559 | A | | 5/1962 | Lindholm | |
| 3,368,808 | A | * | 2/1968 | Worthington | 269/279 |
| 4,002,328 | A | | 1/1977 | Wolf et al. | |
| 4,133,519 | A | * | 1/1979 | Shin et al. | 269/247 |
| 4,241,906 | A | | 12/1980 | Cole | |
| 4,247,090 | A | | 1/1981 | Hahn et al. | |
| 4,273,465 | A | | 6/1981 | Schoen | |
| 4,500,077 | A | | 2/1985 | Coxon | |
| 4,592,541 | A | * | 6/1986 | Huray | 269/155 |
| 4,597,690 | A | | 7/1986 | Girard | |
| 4,607,829 | A | * | 8/1986 | Suska | 269/88 |
| 4,662,618 | A | | 5/1987 | Willis | |
| 4,823,636 | A | * | 4/1989 | Suska | 24/569 |
| 4,962,918 | A | | 10/1990 | Yang | |
| 4,984,775 | A | | 1/1991 | Kahlke | |
| 5,042,127 | A | * | 8/1991 | Lamas | 407/29.15 |
| 5,048,808 | A | * | 9/1991 | Yang | 269/258 |
| 5,058,869 | A | * | 10/1991 | Ruthven | 269/45 |
| 5,058,870 | A | | 10/1991 | Cetnar | |
| 5,192,060 | A | | 3/1993 | Novak | |
| D348,816 | S | * | 7/1994 | Degen | D8/73 |
| 5,405,124 | A | * | 4/1995 | Mayer et al. | 269/45 |
| 5,704,816 | A | * | 1/1998 | Polidori | 439/781 |
| 5,794,897 | A | * | 8/1998 | Jobin et al. | 248/74.4 |
| 5,950,998 | A | | 9/1999 | Crabb | |
| 5,992,802 | A | * | 11/1999 | Campbell | 248/68.1 |
| 6,062,553 | A | | 5/2000 | Strehl | |
| 6,196,519 | B1 | * | 3/2001 | Utterberg | 251/10 |
| 6,688,569 | B1 | * | 2/2004 | Weiss | 248/229.15 |

* cited by examiner

*Primary Examiner*—Joseph J. Hail, III
*Assistant Examiner*—Bryan Muller
(74) *Attorney, Agent, or Firm*—Ira S. Dorman

(57) ABSTRACT

A system of tools and connector assemblies can be erected in numerous arrangements and configurations, in positive, selected interrelationships, for the mounting and support of a workpiece or the like. Engagement portions on the tools are clamped by the clamping blocks comprising a connector assembly; the tools may be C-clamps, bar-clamps, pipe-clamps, coupling devices, brackets, standoffs, and like implements.

41 Claims, 17 Drawing Sheets

43

TOOL AND CONNECTOR SYSTEM FOR CLAMPING

CROSS REFERENCE TO RELATED APPLICATION

This application claims the benefit of U.S. Provisional Application No. 60/391,358, bearing the same title and filed Jun. 25, 2002.

BACKGROUND OF THE INVENTION

Multiple-effect clamping arrangements incorporating various forms of clamps, and providing lateral, overlying, and underlying support for workpieces, are old and well known in the art. Such arrangements are disclosed, for example, in U.S. Pat. Nos. 728,450, 789,405, 812,699, 1,009,609, 1,309,900, 1,352,647, 1,375,686, 1,408,301, 1,410,184, 1,497,862, 2,366,350, 2,606,483, 2,642,905, 3,033,559, 4,002,328, 4,247,090, 4,500,077, 4,592,541, 4,607,829, 4,962,918, 4,984,775, 5,058,870, 5,192,060, 5,405,124, and 5,950,998. Of particular note are Reeder U.S. Pat. No. 1,319,900 and Mayer et al. U.S. Pat. No. 5,405,124, wherein pairs of C-clamps are coupled to function cooperatively.

Connectors having parts that are joined together or urged into clamping engagement by use of bolts are disclosed in U.S. Pat. Nos. 4,273,465, 4,597,690, 5,704,816 and 5,794,897. A unitary supporting member for a wood clamp is disclosed in U.S. Pat. No. 4,662,618, and U.S. Pat. Nos. 4,241,906 and 6,062,552 are directed to novel vises.

Despite the well-developed state of the art indicated by the foregoing, a need remains for a system that affords a high degree of versatility and variation in its applications, and is highly effective in securing components to one another in positive, selected positions and relationships, and is incomplex and relatively inexpensive to manufacture.

SUMMARY OF THE INVENTION

Accordingly, it is a broad object of the present invention to provide a versatile and effective system in which tools of various kinds can be mounted and interengaged in positive, selected positions and relationships, and to provide tools and connector assemblies comprising such a systems.

Other objects of the invention are to provide such a system and components which are of relatively incomplex design and construction, and of relatively facile and inexpensive manufacture.

It has now been found that certain of the foregoing and related objects of the invention are attained by the provision of a system broadly comprised of at least one tool and one connector assembly. The tool has a generally planar engagement portion, with opposite side surfaces and a generally laterally extending outer edge. The connector assembly includes a pair of clamping blocks, and means for coupling the blocks in mutually confronting operative relationship and for urging them toward one another. The assembly is constructed for receiving the engagement portion of the tool between the blocks, and for gripping it with the inner surface of each block bearing upon the confronting side surface of the engagement portion, each inner surface, together with the confronting side surface, thus providing a contact surface pair. First orientation constraint means, comprised of a recess formation and protruding structure seated therein, is provided on the confronting surfaces comprising at least one of the contact surface pairs, and constrains the tool and connector assembly against relative angular movement, thereby positively securely mounting the tool in a selected orientation relative to the connector assembly.

In more specific embodiments of the invention the tool is a clamping tool and the engagement portion thereof has, on at least one of two opposite side surfaces, at least two mutually parallel and transversely spaced, laterally extending raised rib structures (typically, of half-round or triangular cross section). An inner face of one of the blocks of the assembly is formed with a first set of at least two transversely spaced, laterally extending recess formations proximate a first outer edge of the assembly, and is dimensioned and configured for seating the rib structures on the engagement portion of the clamping tool. The blocks of the connector assembly can be tightened upon the engagement portion of the tool, with the rib structures seated in the recess formations, to thereby securely mount the tool in a selected position.

The engagement portion of the clamping tool will preferably have raised rib structures on the other of its opposite side surfaces as well, and generally such rib structures will align with one another, through the thickness of the engagement portion. Rib structures may extend along the inner and outer edges of an engagement portion, and/or they may be disposed intermediate the edges. Although the rib structures and recess formations may advantageously be substantially free from discontinuity along their lengths, with a recess formation extending fully across the inner faces of the connector blocks, gaps or discontinuities may be provided so as to accommodate, for example, a bump in the middle of a casting.

One specific clamping tool suitable for use in the instant system is a C-clamp comprised of two cooperating jaw portions spaced along the length of a back portion, with the engagement portion comprising the back and/or one or both of the jaw portions. Other suitable clamping tools comprise bar clamps and pipe clamps in which the engagement portion may take the form of a flange on at least one of the jaws. The clamping tool may also be a one-piece coupling device comprised of a head portion integrally formed with an engagement portion, the head portion being constructed for snap-fit clamping engagement of a separate member mounted thereon.

The inner face of one of the connector assembly blocks will desirably have laterally extending raised rib structure thereon, which aligns intermediate recess formations in the other block when the blocks are assembled in their operative relationship. At least a second set of recess formations will advantageously be provided proximate a second outer edge of the connector assembly, lying opposite and/or adjacent to the first outer edge, such a connector assembly having particular utility in instances in which the system includes (as will usually be the case) a second tool having an engagement portion thereon. In addition, the inner face of each of the clamping blocks will advantageously be formed with a channel extending fully thereacross, proximate an outer edge of the assembly, the channels being aligned with one another so as to cooperatively form a passage. The connector assembly will normally include means for constraining the blocks to their operative relative orientation, as well as means for biasing the blocks away from one another.

In one specific embodiment of the invention the blocks of the connector assembly are of substantially the same size and are of generally planar, square (or other rectangular form) construction, providing a straight-line or in-line assembly. In another embodiment the blocks are of complementary, generally V-shaped, mating cross section, one block being comprised of two portions angled at 30° to 150° (usually 90°) to one another. Because of an inherent ability to compensate for structural variations and manufacturing tolerances, the faces of the mating block of such an angle connector assembly may advantageously be flat and unconfigured (i.e., devoid of rib structures or recess formations).

Other objects of the invention are attained by the provision of a tool, as described herein. And still further objects are attained by the provision of a coupling assembly, also as herein described.

Thus, the present system includes a variety of connector assemblies and "tools," which term is intended broadly to include adjustable and fixed clamps, connector and standoff devices, mounting supports, and like implements, and which tools can readily be assembled with one another in various combinations and in positive, selected relationships, for a variety of purposes. A connector assembly will usually be used to grip and join two tools, such as a C-clamp and a bar clamp, two C-clamps, a clamp and a coupling device or mounting bracket, etc. A single raised rib structure may be provided on either or both sides of an engagement portion; structures that are functionally equivalent to laterally extending ribs and recesses can be employed, the positions of ribs and recesses on a on tool and on connector blocks can be reversed, and other modifications are contemplated. The connector assembly may employ two or three sets of rib structures and recess formations along two or three margins, disposed outwardly of a central fastening member to provide optimal versatility of applications.

Figure 52:
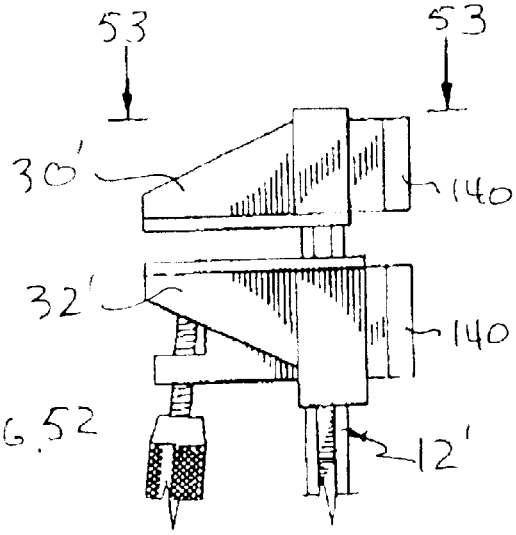
Figure 53:
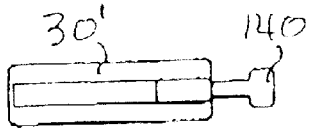
Figure 54:
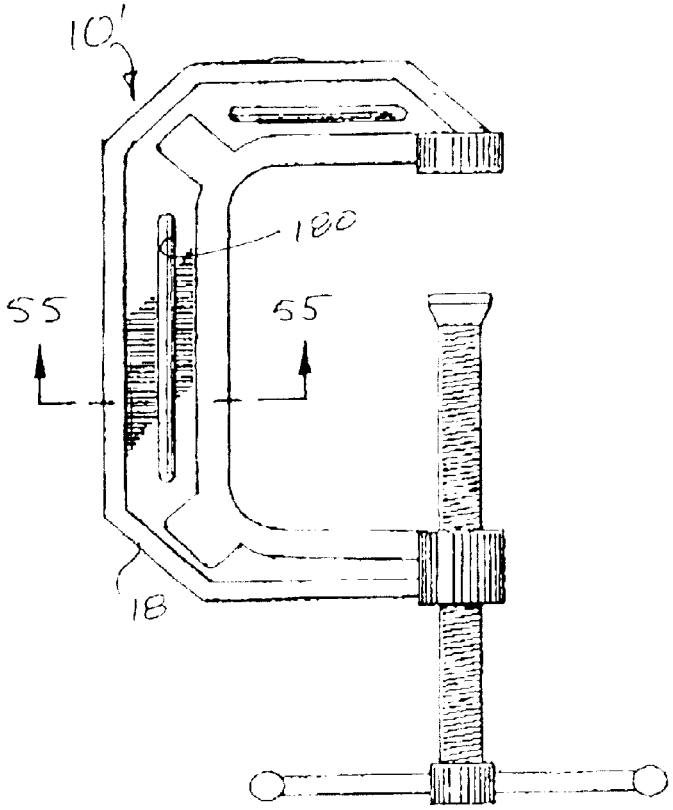
Figure 55:
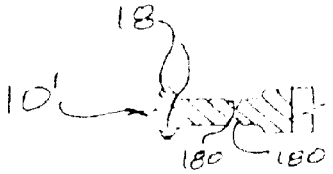
Figure 56:
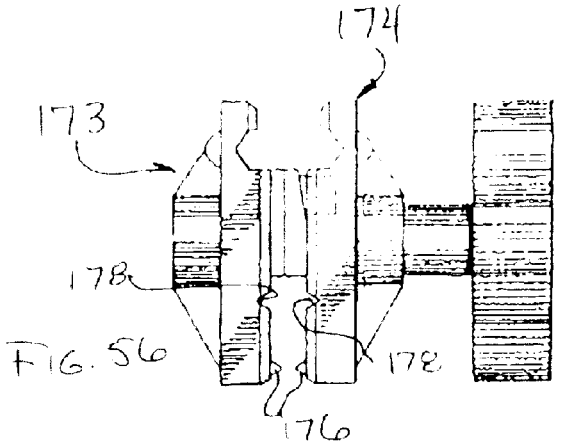
Figure 57:
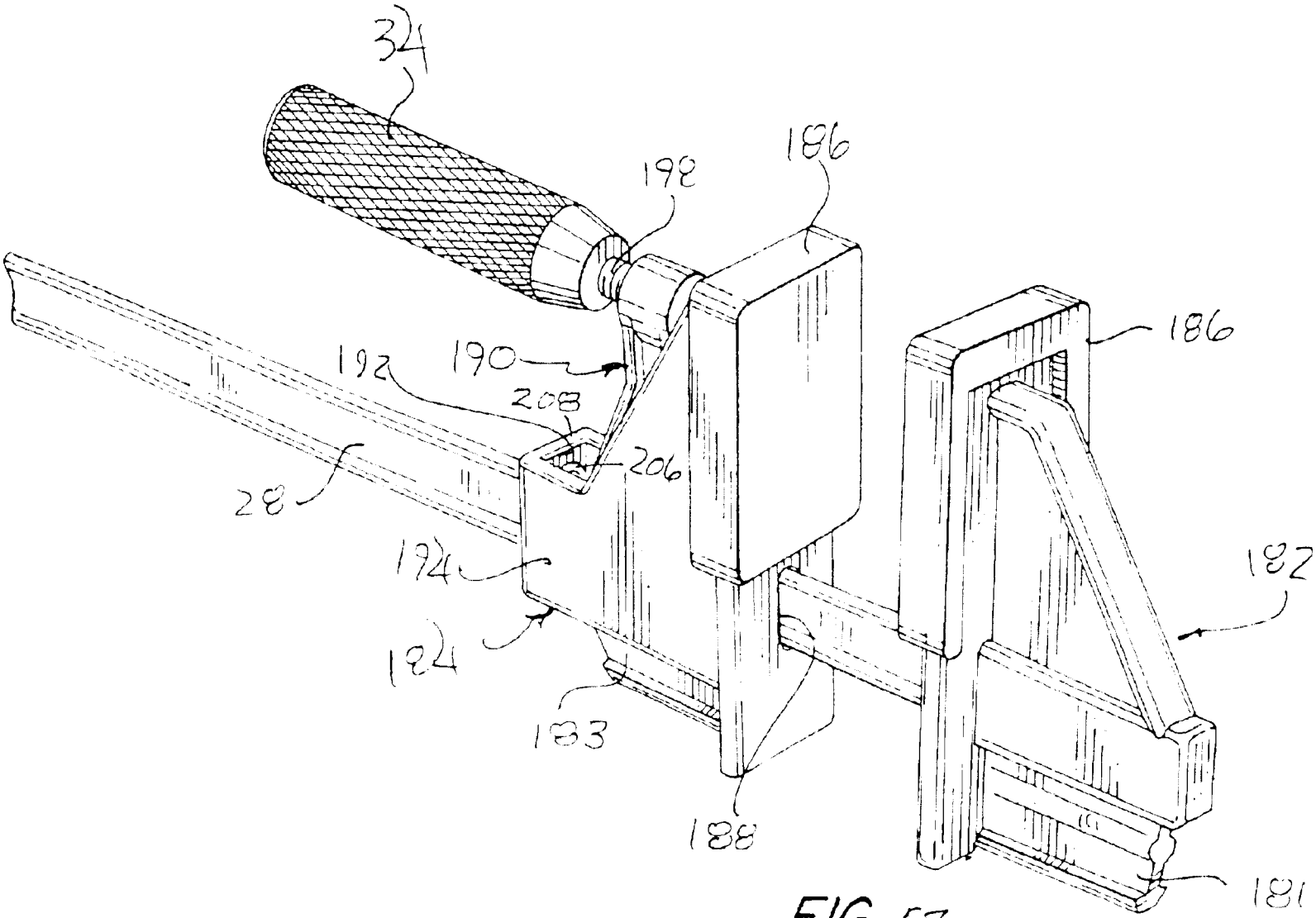
Figure 58:
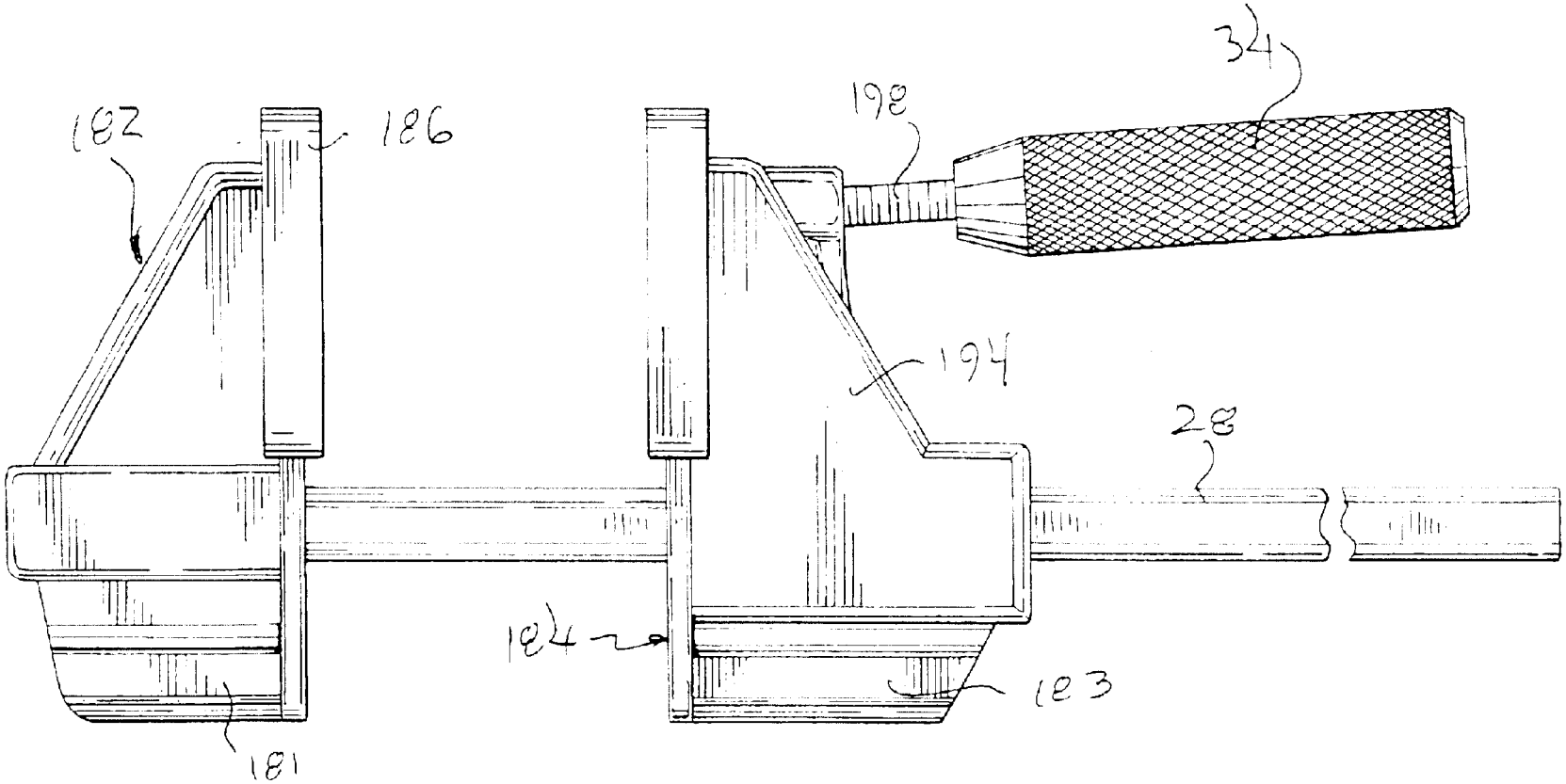
Figure 59:
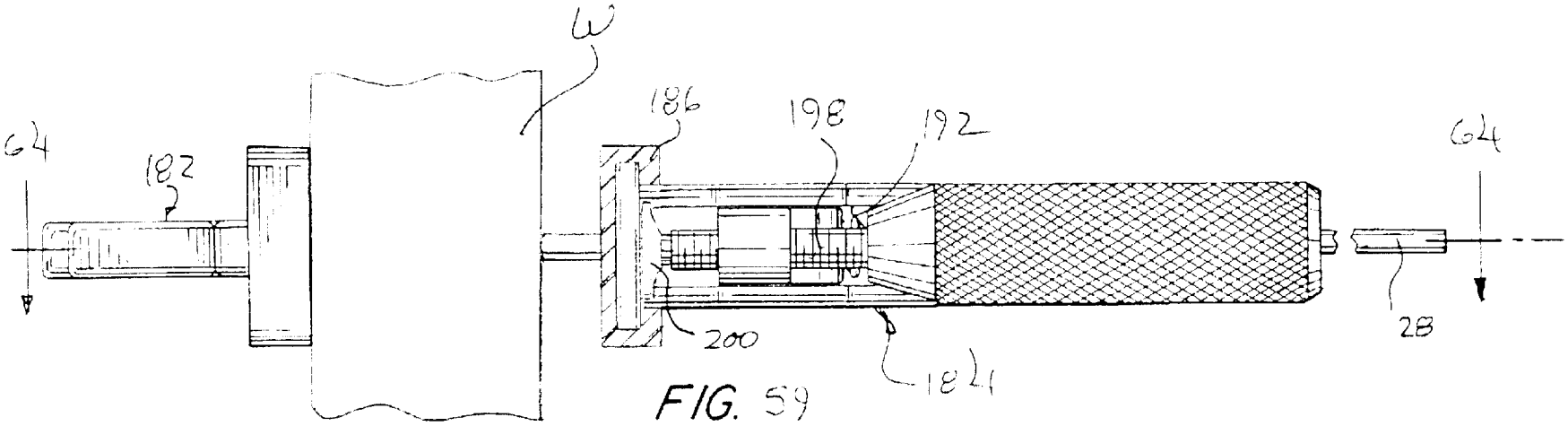
Figure 60:
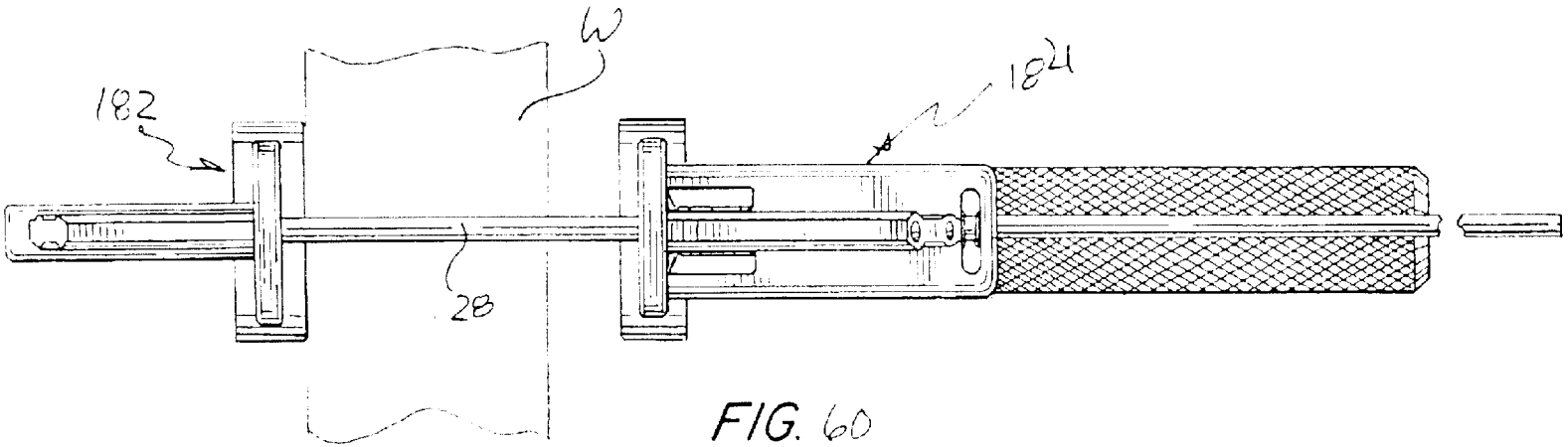
Figure 61:
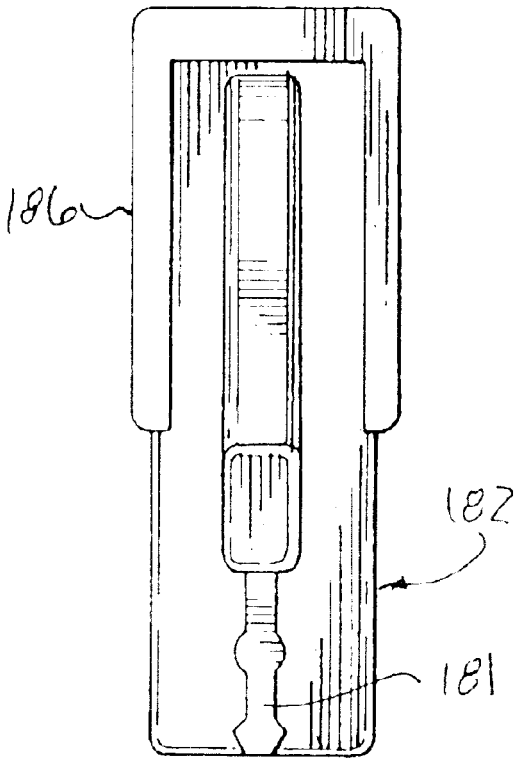
Figure 62:
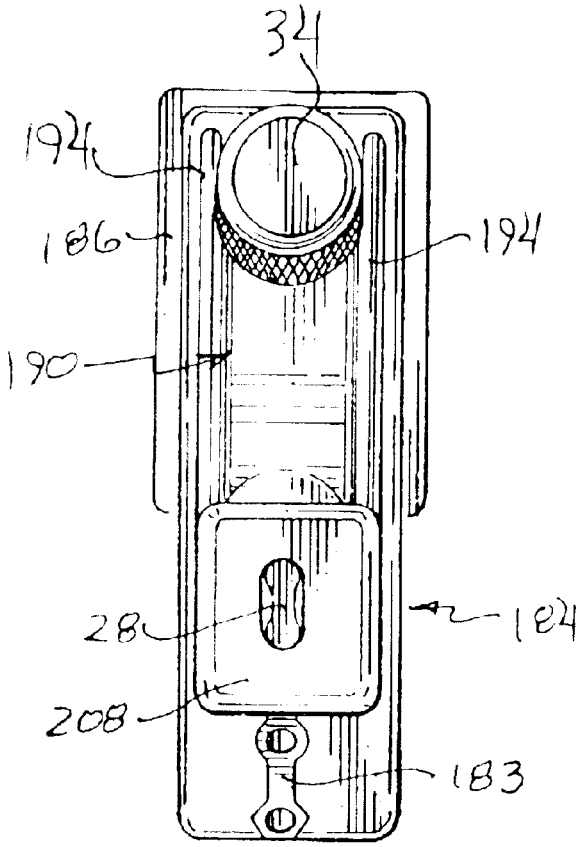
Figure 63:
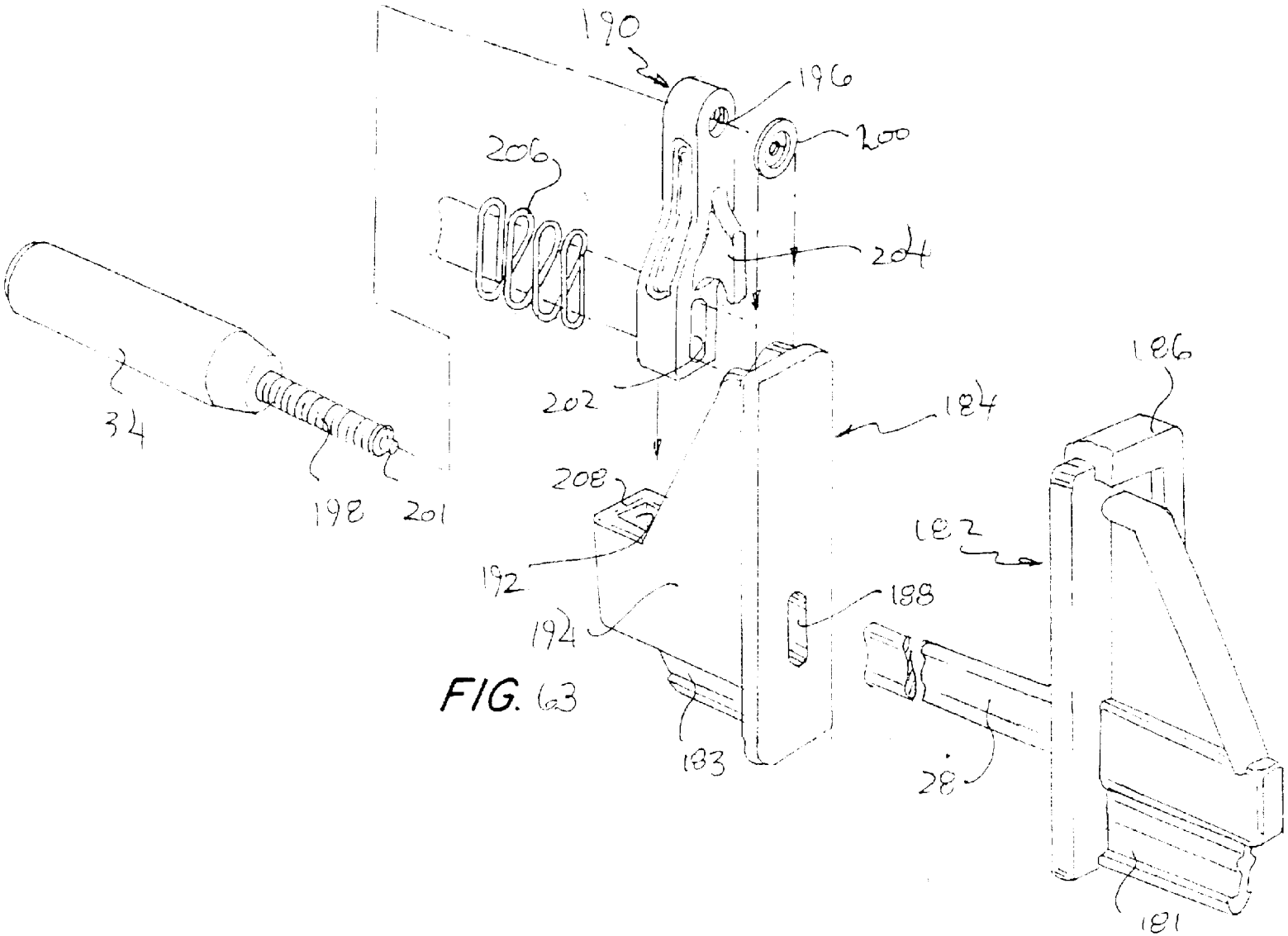
Figure 64:
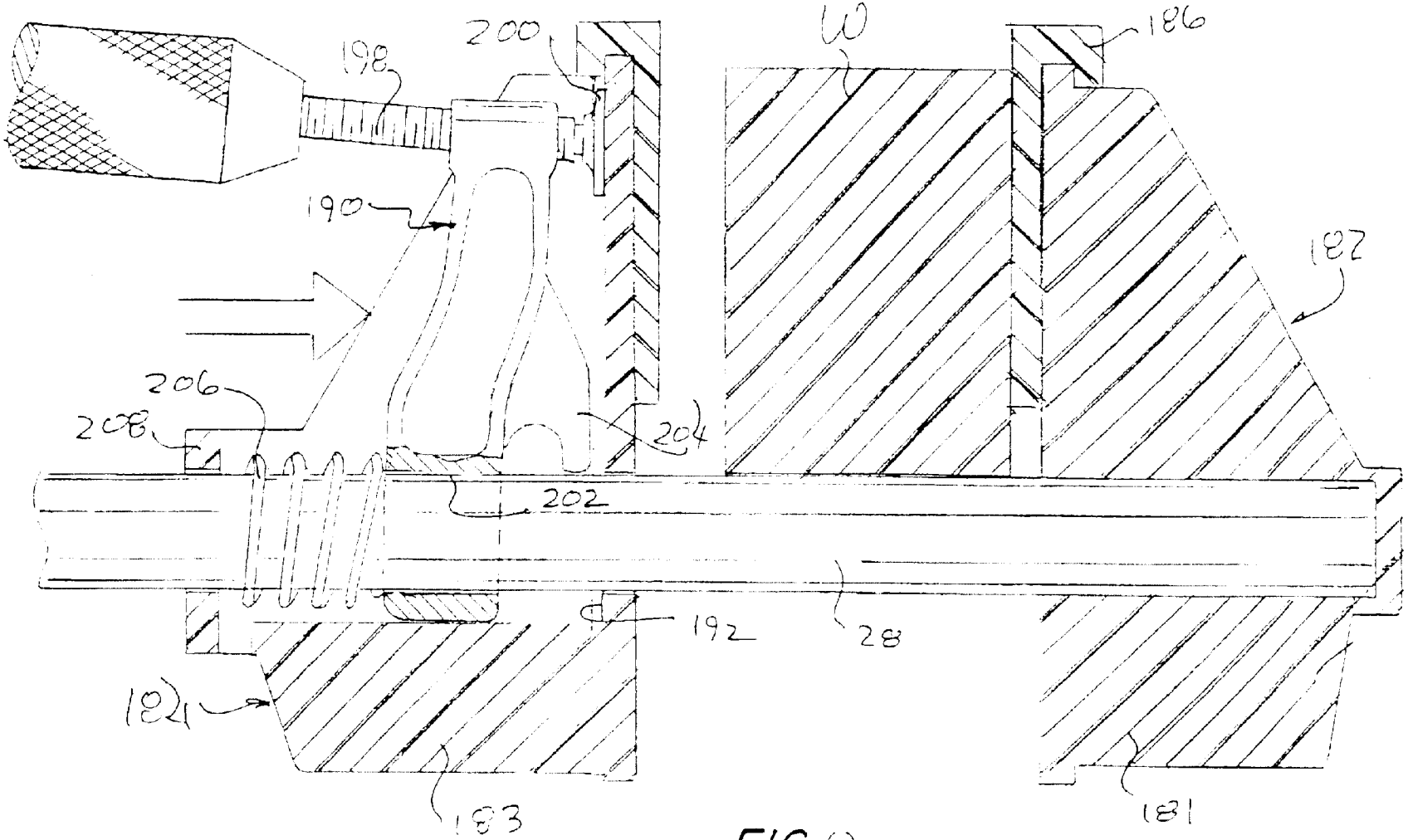
Figure 65:
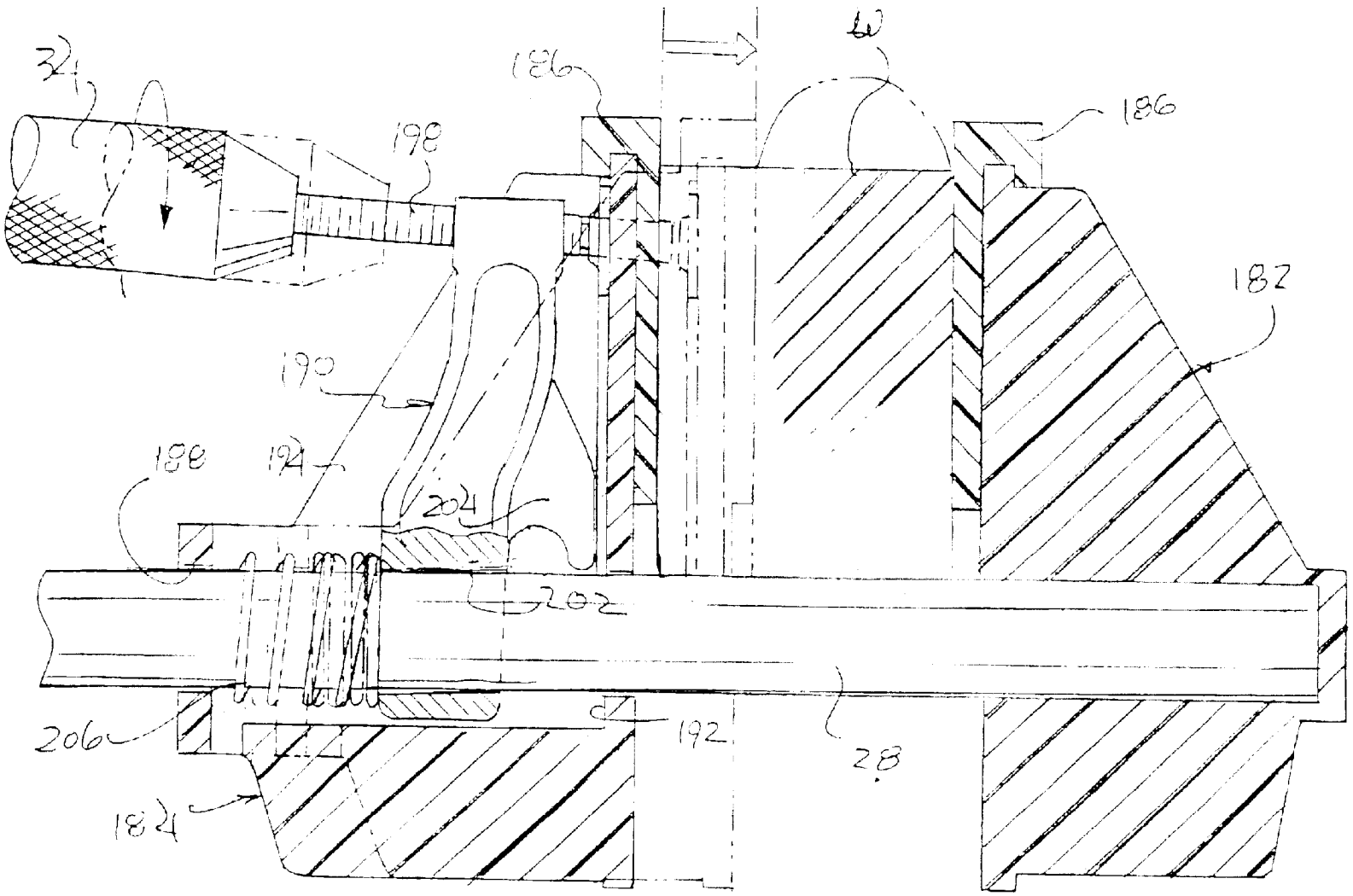

FIG. 52 is a side elevational view of a second form of bar clamp embodying the present invention;

FIG. 53 is an end view of the bar clamp of FIG. 52, viewed on line 53—53 therein;

FIG. 54 is a side elevational view of another form of C-clamp embodying the present invention;

FIG. 55 is a sectional view of the C-clamp of FIG. 54, taken along line 55—55 thereof;

FIG. 56 is an elevational view of an in-line connector assembly embodying the present invention and suitable for use to grip the engagement portion of the C-clamp depicted in FIGS. 54 and 55;

FIG. 57 is a perspective view of a bar clamp embodying the invention;

FIG. 58 is a side elevational view of the bar clamp;

FIGS. 59 and 60 are plan and bottom views of the bar clamp;

FIGS. 61 and 62 are front and rear views of the bar clamp;

FIG. 63 is an exploded perspective view of the bar clamp;

FIG. 64 is a sectional view of the bar clamp taken along line 64—64 in FIG. 59; and FIG. 65 is a second sectional view showing the adjustable jaw of the bar clamp moved to position in engagement with a workpiece.

DETAILED DESCRIPTION OF THE PREFERRED AND ILLUSTRATED EMBODIMENTS

Figure 1:
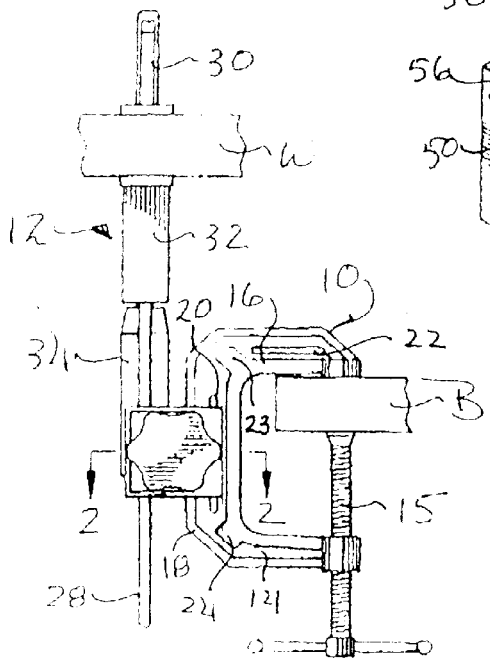
FIG. 1 is an elevational view of a system embodying the invention, showing a C-clamp connected to a bar clamp, using an in-line connector assembly.
Figure 3:
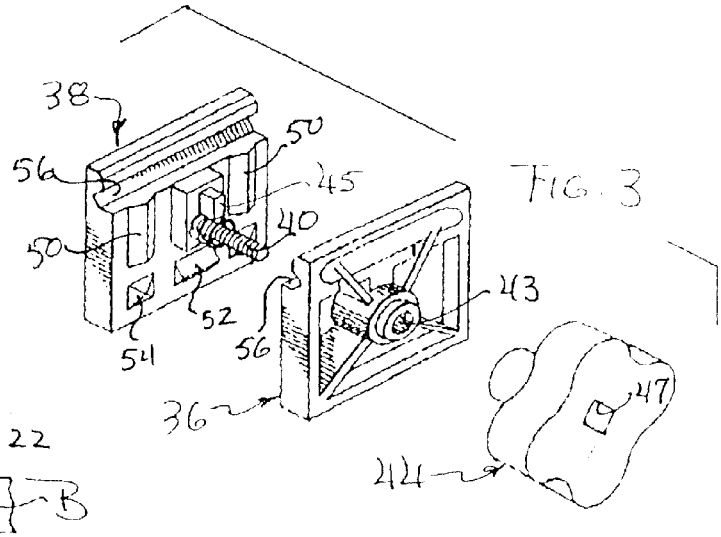
FIG. 3 is an exploded perspective (isometric) view of the connector assembly utilized in the system of FIG. 1, drawn to an enlarged scale.
Figure 5:
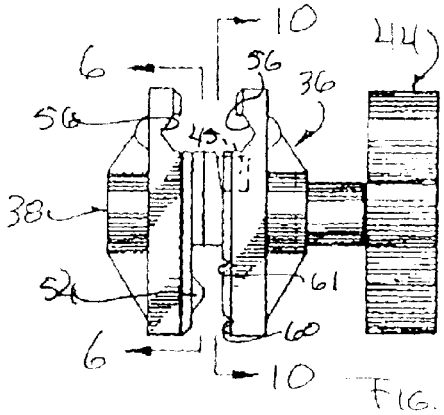
FIG. 5 is an elevational, adjacent end view of the connector assembly.
Figure 4:
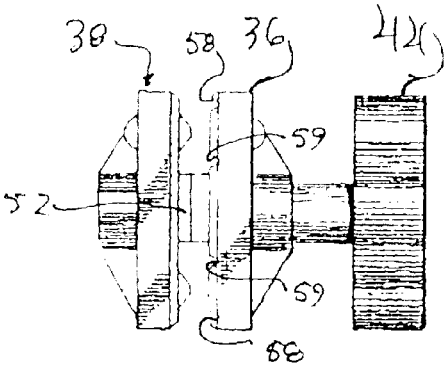
FIG. 4 is an end elevational view of the connector assembly.
Figure 2:
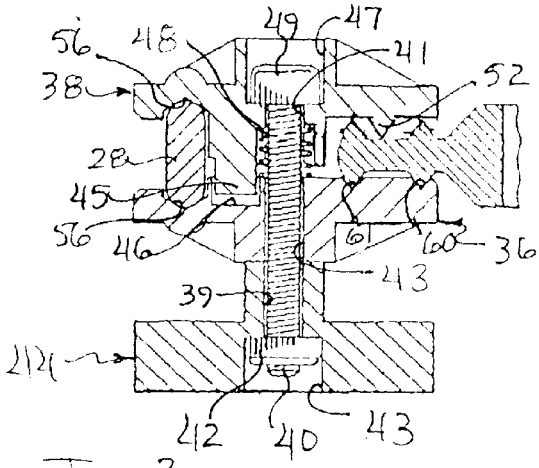
FIG. 2 is a cross sectional view of the system of FIG. 1, taken along line 2—2 thereof and drawn to an enlarged scale.
Figure 6:
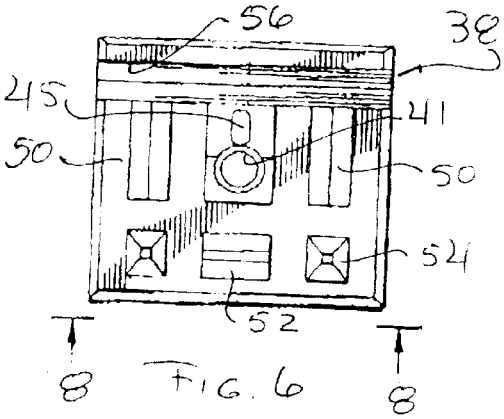
FIG. 6 is an elevational view of the inner surface of the exterior block of the connector assembly, taken along line 6—6 of FIG. 5.
Figure 7:
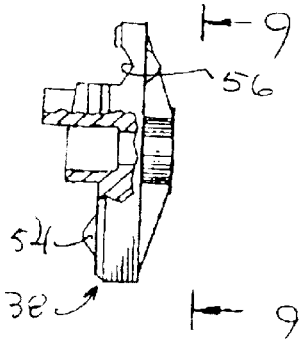
FIG. 7 is an end elevational view of the exterior block of the connector assembly, partially broken away.
Figure 8:
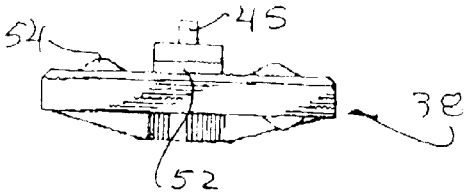
FIG. 8 is an adjacent end elevational view of the exterior block, viewed on line 8—8 of FIG. 6.
Figure 9:
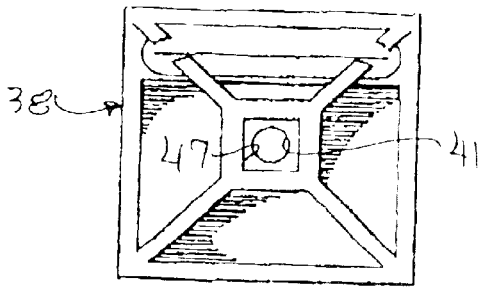
FIG. 9 is an elevational view of the outer surface of the exterior block of the assembly, viewed on line 9—9 of FIG. 7.
Figure 10:
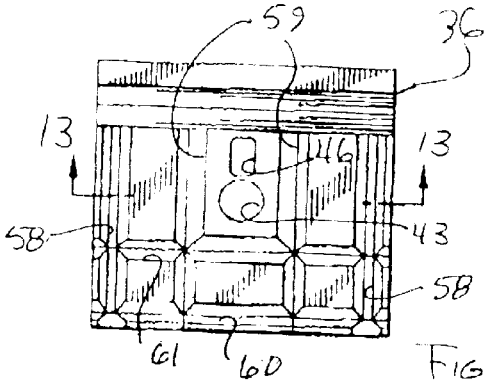
FIG. 10 is an elevational view of the inner surface of the exterior block of the assembly, viewed on line 10—10 of FIG. 5.
Figure 11:
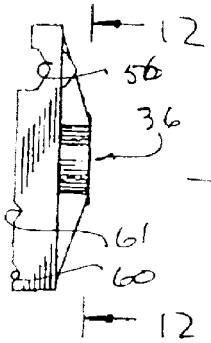
FIG. 11 is an end elevational view of the interior block of the connector assembly.
Figure 12:
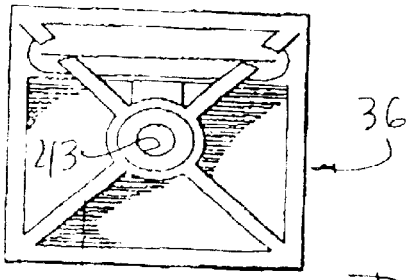
FIG. 12 is an elevational view of the outer surface of the interior block, viewed on line 12—12 of FIG. 11.
Figure 13:
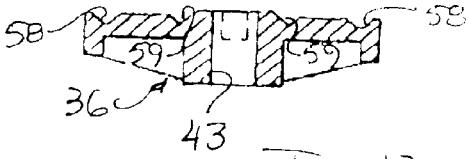
FIG. 13 is a sectional view of the interior block, taken along line 13—13 of FIG. 10.

Turning initially to FIGS. 1 and 2 of the drawings, therein illustrated is a system embodying the present invention and consisting of a C-clamp and a bar clamp, generally designated respectively by numerals 10 and 12, interengaged by an in-line connector assembly. While having unique features, the C-clamp 10 is of basically conventional construction and consists of a C-shaped frame 14 and a clamping screw subassembly 15; the screw subassembly 15 and the upper jaw fasten the C-clamp to a bench B. The frame 14 has peripheral flanges or fillets 16, 18 extending respectively about its interior and exterior margins, and intermediate rib elements 20, 22 extend between the fillets 16, 18 on the back and upper jaw portions, respectively; reinforcing boss elements 23, 24 are provided at the junctures of the back and jaw portions. It will be appreciated that the opposite side of the frame has identical features, arranged in mirror-image relationship.

The bar clamp 12 consists of a rectilinear bar 28, to one end of which is attached a fixed jaw 30. A cooperating jaw 32 is slidably mounted on the bar 28 and is tightened against a workpiece W by turning the handle 34, to which a force-generating screw is attached.

As is best seen in FIG. 2, and with additional reference now to FIGS. 3–13, the connector assembly used to interengage the clamps 10 and 12 consists of square, generally planar interior and exterior blocks, generally designated respectively by the numerals 36 and 38. A square-headed bolt 40 extends through passages 41 and 43 in the blocks 38 and 36, and through an aligned passage 39 in an operating handle, generally designated by the numeral 44. The head 49 of the bolt 40 is engaged in a square recess 47 in the block 38, and a square nut 42, threaded on the end of the bolt 40, is seated in a corresponding recess 43 formed in the handle 44. As will be appreciated, rotation of the handle 44 advances the nut 42 on the bolt 40, thereby urging the blocks 36, 38 together against the biasing force of a coil spring 48, which is disposed within an enlarged-chamber section (unnumbered) of the passage 41. A small lug 45 projects from the inner face of the exterior block 38 into a recess 46 formed in confronting face of the interior block 36, thereby constraining the assembled blocks to the proper relative relationship.

The exterior block 38 has formed on its inner surface a pair of parallel rib structures 50, as well as pyramidal corner bosses 54 and a short rib element 52 therebetween (which together constitute raised rib structure). The inner surface of the interior block 36 is formed with a rectilinear groove or recess formation 58 along each of its opposite lateral margins, and with parallel rectilinear grooves 59 spaced inwardly therefrom; a similar pair of parallel rectilinear grooves 60, 61 extend laterally along the adjacent margin. Each of the blocks 36, 38 also has a rectilinear channel 56 extending thereacross, which is wide and deep relative to the recess formations.

As seen in FIG. 2, the bar 28 of the bar clamp is seated in the channels 56 of the two blocks, which cooperatively define a passage across the connector assembly. The intermediate rib structure 20 on the back portion of the C-clamp 10 is seated in the recess formation 60 adjacent the opposite margin of the interior block 36, with the edge of the exterior marginal flange 18, on one side of the clamp, seated in the inwardly adjacent recess formation 60'. The short rib element 52, and the pyramidal bosses 54, bear upon the opposite side of the flame 14, in the area between the rib element 20 and the flange 18, to rigidly secure the engaged portion of the C-clamp in a fixed position when the blocks 36, 38 are tightened thereupon (by rotation of the handle 44). As will be appreciated, in smaller clamps the peripheral fillets 16 and 18 may desirably provide rib structures constituting the engagement portion to which the connector assembly is attached.

Figure 14:
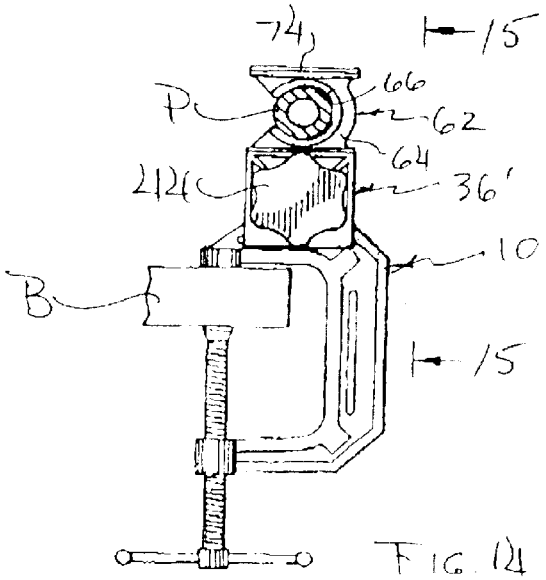
FIG. 14 is an elevational view of another system embodying the invention and comprised of a C-clamp connected to a pipe by an in-line connector assembly and a coupling device.
Figure 15:
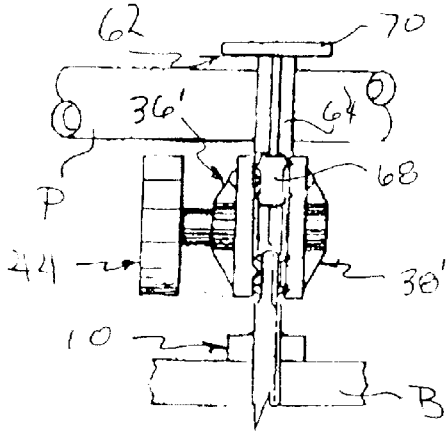
FIG. 15 is a fragmentary elevational view of the system of FIG. 14, viewed on line 15—15 therein.
Figure 16:
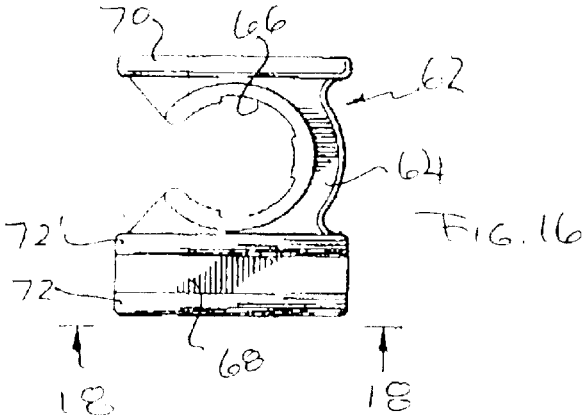
FIG. 16 is a side elevational view of the coupling device utilized in the system of FIGS. 14 and 15, drawn to an enlarged scale.

The system depicted in FIGS. 14 and FIG. 15 is similar to that shown in FIGS. 1 and 2, with the exception that one of the tools employed is a pipe coupling device, generally designated by the numeral 62, rather than the bar clamp employed therein, and the rib and recess locations are reversed on the connector blocks. In the configuration depicted, moreover, the connector assembly is attached to the upper jaw of the C-clamp rather than the back portion, engaging the rib formation 22 thereon (together with the exterior flange portion 18).

The pipe coupling device 62 is integrally formed, as a single piece, from a suitable synthetic resinous material (e.g., polypropylene), and includes a head portion 64 defining a generally C-shaped opening 66, an engagement portion 68, and a support portion 70. As can be seen, a pipe P is secured in the opening 66 of the head portion 64, it being appreciated that the material of fabrication is sufficiently resiliently deflectable to permit passage through the relatively narrow entrance opening, for snap-fit seating.

Figure 17:
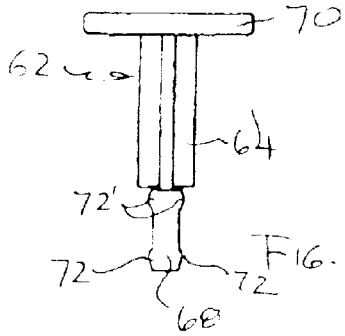
FIGS. 17 and 18 are end and bottom views of the coupling device.
Figure 18:
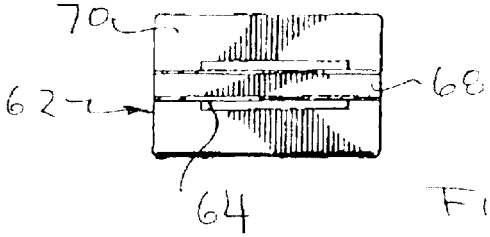

The engagement portion of the device 62 is formed with a pair of parallel rib elements 72, 72' extending laterally along each side, the corresponding side elements (i.e., 72, 72 and 72', 72') being mutually aligned through the thickness of the portion 68 (as best seen in FIG. 17). As will be appreciated, the connector assembly is secured upon the engagement portion 68 with the rib elements 72, 72' on one side seated in the recess formations 60, 60' on the exterior block 38' and with the projecting elements 52, 54 on the interior block 36' cooperating therewith in the manner hereinabove described.

Figure 19:
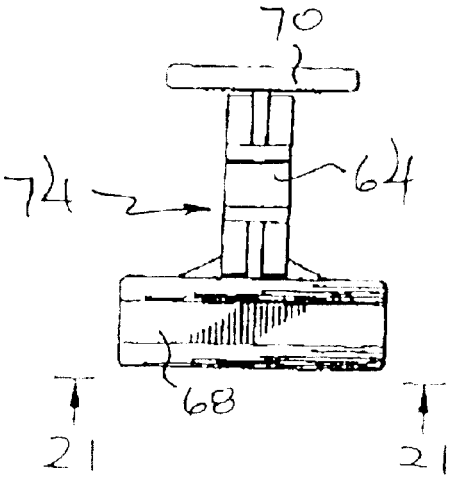
FIGS. 19, 20 and 21 are similar to FIGS. 16, 17 and 18 but show a modified form of coupling device in which the engagement portion is rotated 90° to lie perpendicular to the plane of the head portion.
Figure 20:
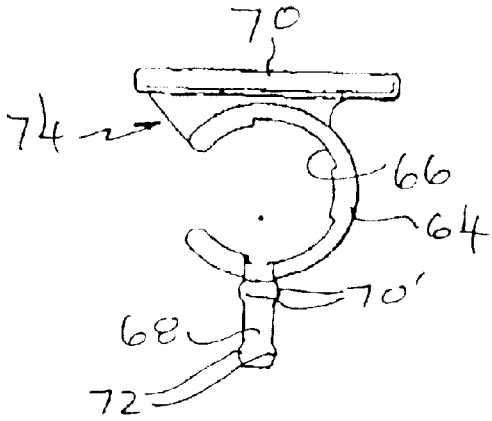
Figure 21:
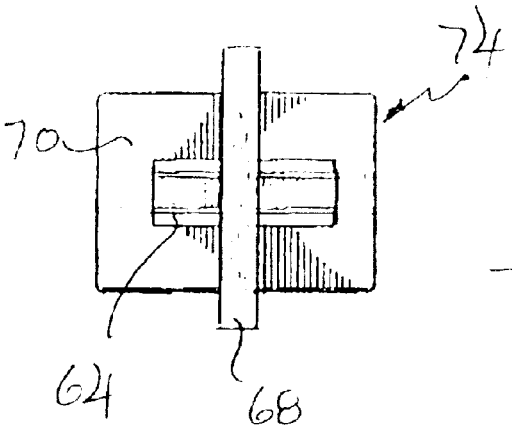

FIGS. 19 through 21 illustrate a slightly modified form of pipe coupling device, generally designated by the numeral 74, in which the engagement portion is rotated 90° so as to lie perpendicular to the plane of the head portion 76. This of course enables the pipe P to be mounted in the plane of the C-clamp rather than normal thereto. Although not illustrated, it will of course be appreciated that the dimensions of the head portion of the pipe clamp may vary so as to accommodate pipes of various sizes.

The platform 70 of the snap-on device can be utilized for various purposes, especially for providing underlying support for a workpiece. This function has particular application in instances in which the pipe P is a component of a pipe clamp, as described below in reference to FIGS. 37 through 41. The platform 70 would prevent contact with the pipe, and thereby minimize marring of the workpiece, or other damage. On the other hand, such coupling devices can be used without any connector assembly, positioned so that its engagement portion merely rests upon an underlying surface, thus functioning as a standoff to support a span of the bar or pipe of an elongate clamping mechanism.

Figure 22:
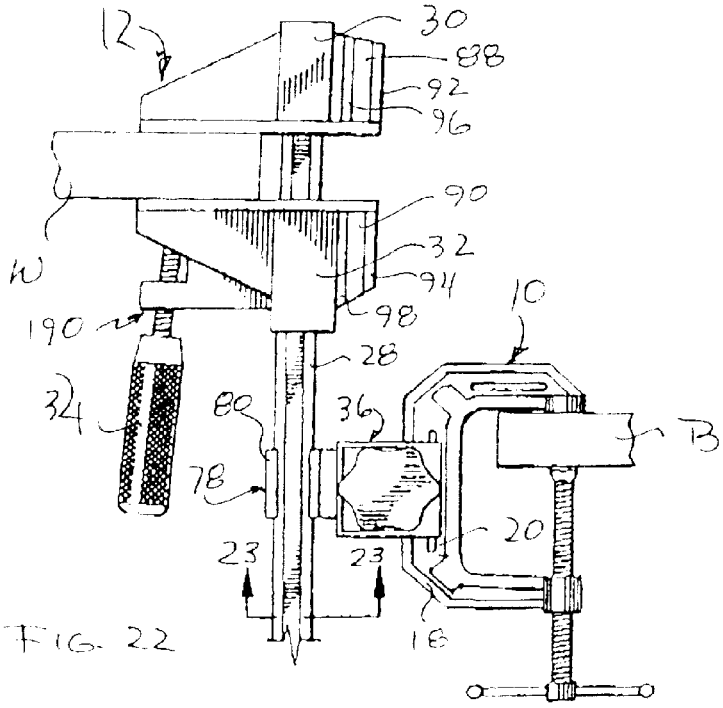
FIG. 22 is an elevational view of another system embodying the invention, mounted on a work bench and comprised of an in-line connector assembly, a C-clamp, a bar clamp, and a coupling device.
Figure 23:
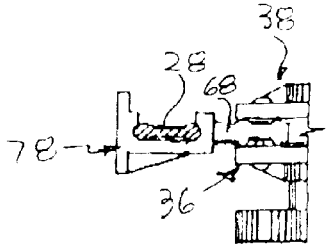
FIG. 23 is a fragmentary view of the system of FIG. 22, taken along line 23—23 therein.

A modified form of such a snap-on device is utilized for coupling a C-clamp and a bar clamp in the system depicted in FIGS. 22 and 23. The C-clamp and the bar clamp have the features hereinabove discussed (albeit additional features of the bar clamp are described below), as has the connector assembly. In this system, however, the connector assembly is utilized to interengage the C-clamp and the coupling device, generally designated by the numeral 78, for gripping the bar 28 to thereby attach the bar clamp to the work bench B in vertical orientation.

Figure 24:
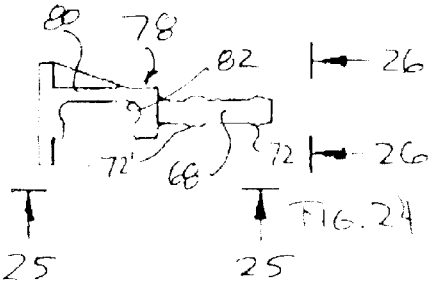
FIG. 24 is an end elevational view of the coupling device utilized in the system of FIGS. 22 and 23, drawn to an enlarged scale.
Figure 25:
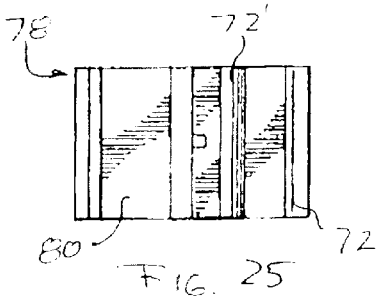
FIGS. 25 and 26 are front and bottom views of the coupling device of FIG. 24, taken on lines 25—25 and 26—26, respectively, therein.
Figure 26:
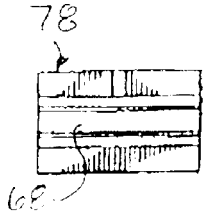
Figure 27:
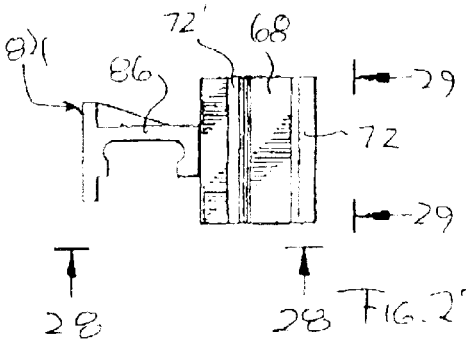
FIGS. 27, 28 and 29 are, respectively, elevational, front, and bottom views of a modified from of coupling device for a bar clamp, FIGS. 28 and 29 being taken on lines 28—28 and 29—29 of FIG. 27, respectively.
Figure 28:
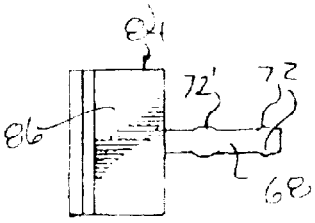
Figure 29:
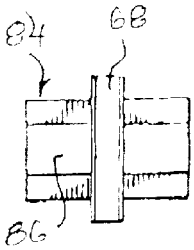

As is best seen with additional reference to FIGS. 24 through 26, the bar coupling device 78 has an engagement portion 68 which is substantially the same as that utilized of the pipe coupling devices shown in FIGS. 14–21, but the head portion 80 and the passage 82 there-through are of course specifically dimensioned and configured for snap-fit engagement of the bar 28. Here again, the device may be constructed with its engagement portion 68 rotated 90° relative to the head portion, as illustrated in FIGS. 27 through 29, wherein the coupling device is generally designated by the numeral 84 and is comprised of a head portion 86 and an engagement portion 68.

Figure 30:
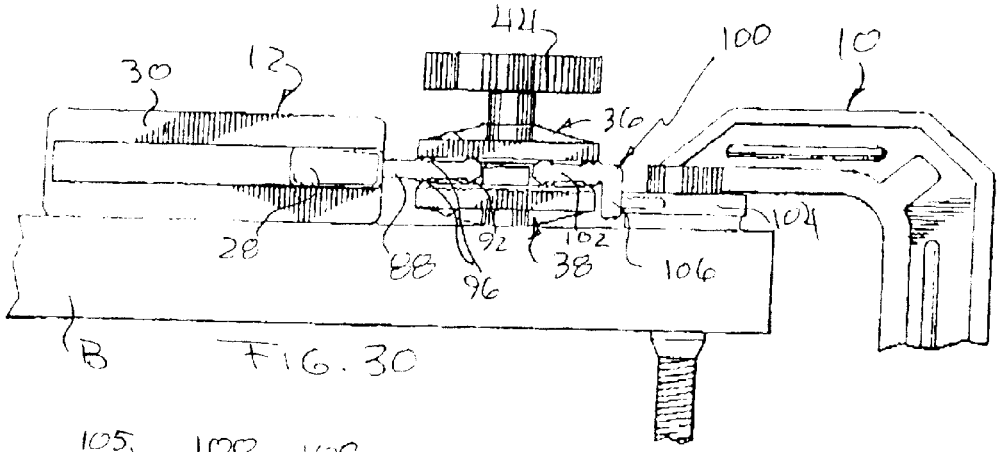
FIG. 30 is an elevational view showing still another system embodying the present invention, comprised of a C-clamp, a straight-line connector assembly, a bar clamp and a coupling device.

FIG. 30 depicts another system for securing a bar clamp, supported upon a bench B, utilizing a C-clamp and the straight-line connector assembly previously described. An engagement portion provided on one of the jaws of the bar clamp is gripped on one side of the connector, and the engagement portion of a coupling bracket (offset accessory), generally designated by the numeral 100, is gripped on the transversely opposite side. Both of the jaw components 30, 32 of the bar clamp are formed with engagement portions 88 and 90, respectively, and each engagement portion has a rectilinear rib element 92, 94 extending laterally along its outer margin and a parallel rib element 96, 98 spaced inwardly thereof. The engagement portion 88 is gripped by the connector assembly in the manner and relationship previously described with respect to other embodiments of the invention.

Figure 31:
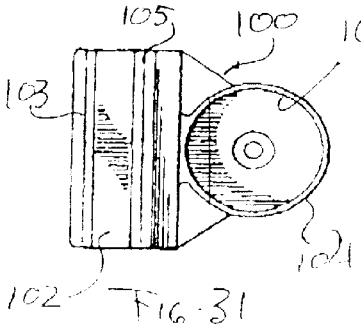
FIGS. 31, 32 and 33 are, respectively, plan, side, and bottom views of the coupling device used in the system of FIG. 30, the side view depicting the device in partial section.
Figure 32:
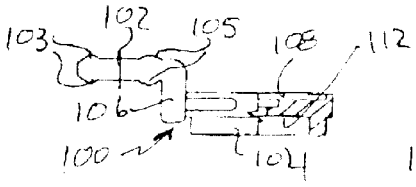
Figure 33:
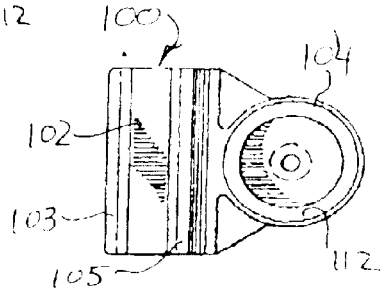

The coupling bracket 100 is most fully illustrated in FIG. 31 through 33, and consists of an engagement portion 102 having transversely extending rib element 103 and 105 on both opposite sides (and mutually aligned), a circular head portion 104, and an offsetting shoulder portion 106. The head portion 104 is formed with a circular recess 108 to receive the contact element on the outer end of the C-clamp jaw, as well as a small central hole adapted to receive a screw for fastening the bracket directly to a support surface. Although the head portion is depicted as having an upwardly extending recess 112, in many instances a flat bottom surface will be preferred.

Figure 34:
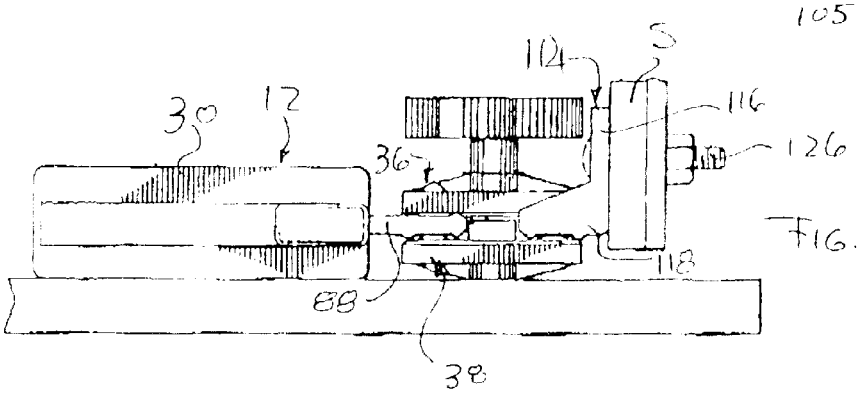
FIG. 34 is an elevation view of a further system embodying the invention, comprised of an in-line connector assembly, a second form of coupling device, and a bar clamp.
Figure 35:
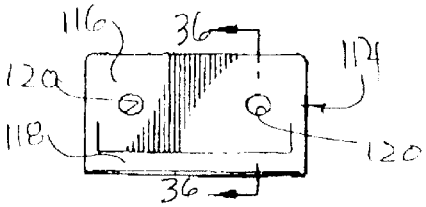
FIGS. 35 and 36 are, respectively, front elevational and sectional views the device utilized in the system of FIG. 34, the sectional view being taken along line 36—36 of FIG. 35.
Figure 36:
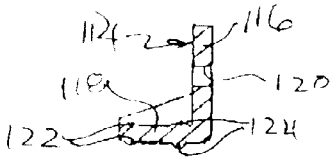
Figure 37:
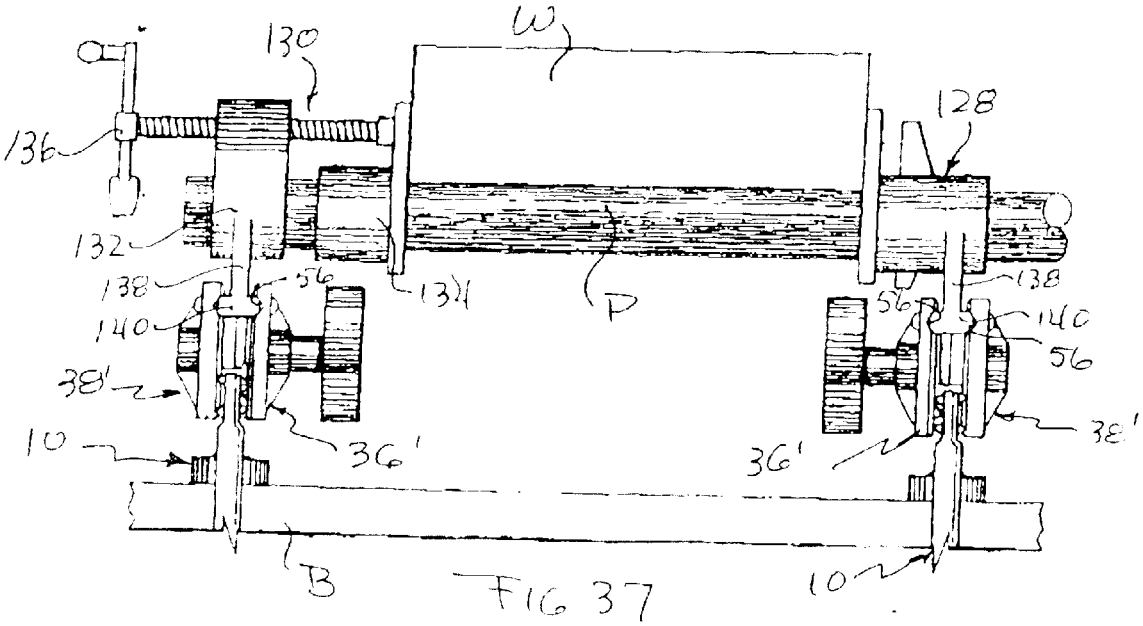
FIG. 37 is an elevational view of a still further system embodying the invention, comprised of two C-clamps, associated in-line connector assemblies, and a pipe clamp.
Figure 38:
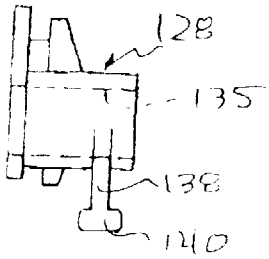
FIGS. 38 and 39, and FIGS. 40 and 41, are, respectively, side and end elevational views of the fixed jaw component and the jaw assembly of the pipe clamp utilized in the system of FIG. 37.
Figure 39:
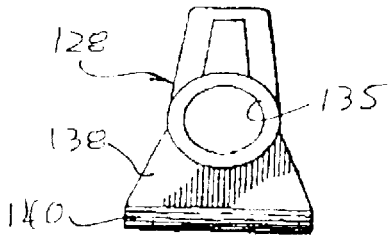
Figure 40:
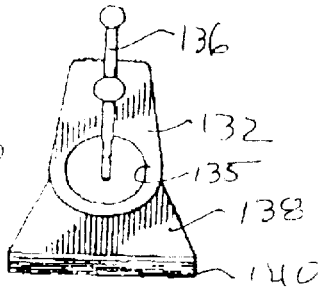
Figure 41:
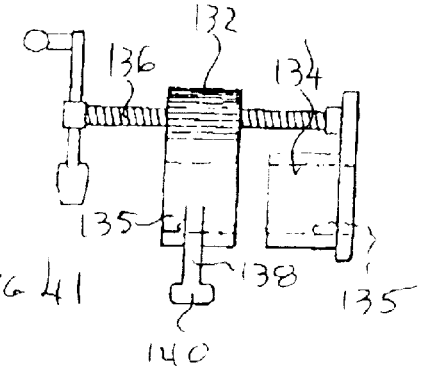

A different form of coupling bracket is employed in the system of FIG. 34, and is more fully illustrated in FIGS. 35 and 36. In this instance the bracket, generally designated by the numeral 114, consists of a mounting panel 116 and a perpendicular engagement portion 118. As depicted in FIG. 34, the engagement portion 118 is gripped by the connector assembly, and the panel 116 is secured to a vertical support S, two holes 120 being formed therethrough to receive mounting bolts 126. Here again, the engagement portion 118 is formed on its opposite sides with laterally extending raised rib structures 122 along a forward edge, and parallel rib structures 124 spaced inwardly therefrom.

FIGS. 37 through 41 illustrated a pipe clamp, and components thereof, supported above a bench B by a pair of C-clamps and associated connector assemblies. The pipe clamp consists of a fixed jaw component, generally designated by the numeral 128, a movable jaw assembly generally designated by the numeral 130, and a pipe P, the fixed jaw 128, the fixed component 132, and the movable jaw 134 being formed with circular openings to receive the pipe. As will be appreciated, clamping of a workpiece W is effected by rotation of the screw assembly 136 for advance and retraction of the movable jaw component 134 relative to the stationary component 132.

Each of the fixed components 128 and 132 is formed with an engagement portion comprised of a web element 138 and a foot element 140, affording a generally T-shaped cross section to the engagement portion. Mounting is effected by engaging the foot elements 140 in the through passage of the connector assembly, defined by the channels 56 (used to receive the bar 28 of the bar clamp, as shown in FIG. 2). Alternatively, the pipe clamp may be supported with the foot elements 140 resting directly upon an underlying surface, in which case one or more of the pipe coupling devices hereinabove described may be advantageously be applied along the length of the pipe P to serve as a standoff and provide additional support (it being appreciated that the standoffs are dimensioned to cooperate with the pipe components in such manner).

Figure 42:
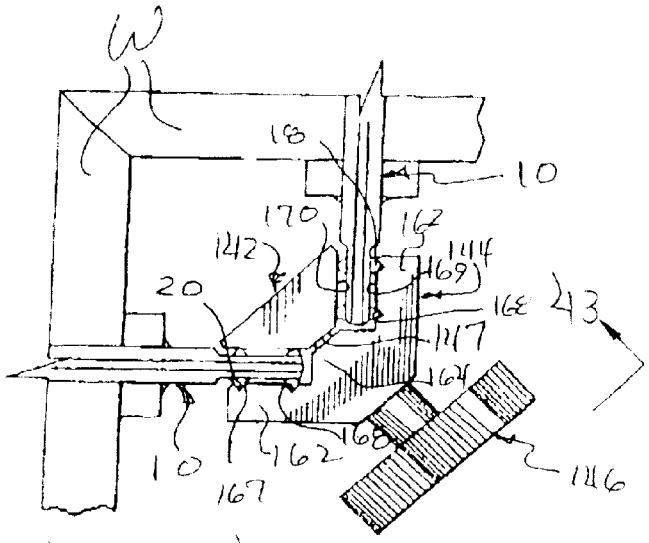
FIG. 42 is an elevational view of a system embodying the present invention, comprised of a pair of C-clamps held at a right angle by an angle, or miter, connector assembly.
Figure 43:
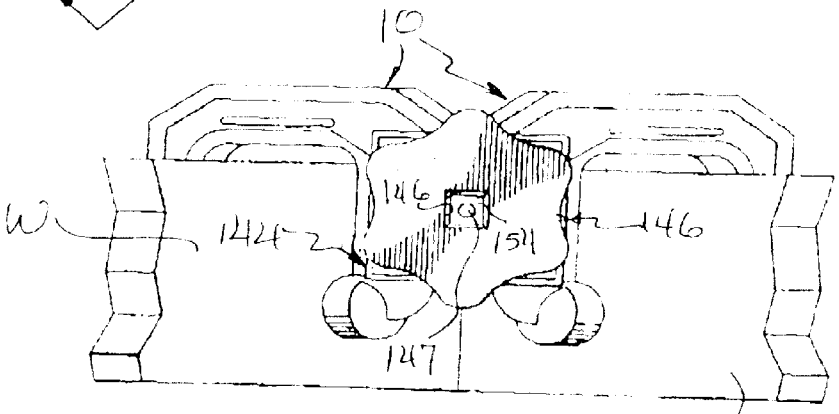
FIG. 43 is an elevational view of the system of FIG. 42, viewed on line 43—43 therein.
Figure 44:
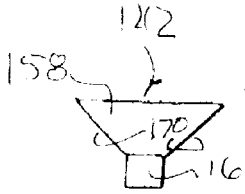
FIGS. 44, 45, 46 and 47 are, respectively, end, front, side and rear views of the exterior block constituting the angle connector assembly utilized in the system of FIG. 42, FIGS. 45, 46 and 47 being taken, respectively, on line 45—45 in FIG. 44, line 46—46 in FIG. 45 and line 47—47 in FIG. 46.
Figure 45:
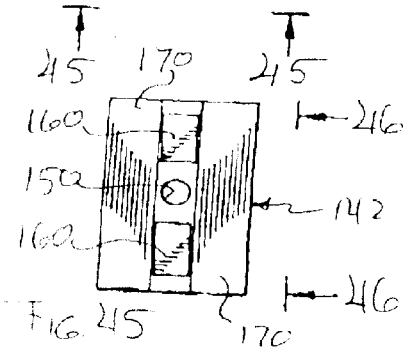
Figure 46:
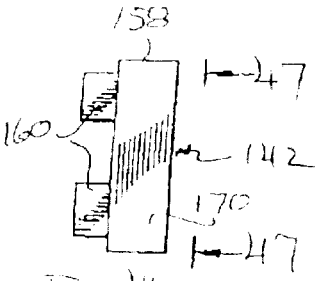
Figure 47:
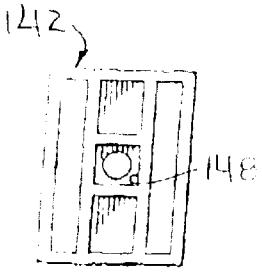
Figure 49:
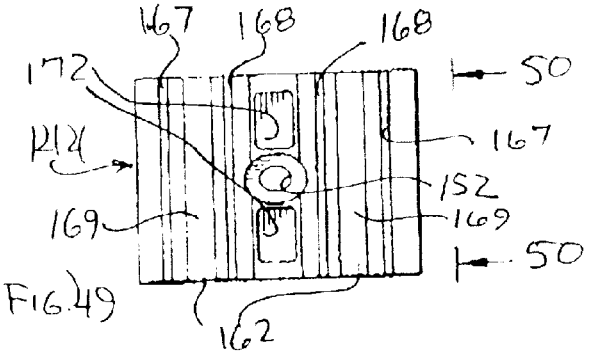
FIGS. 48, 49, 50 and 51 are corresponding views of the interior block comprising the angle connector of FIGS. 42 and 43, FIGS. 49, 50 and 51 being taken, respectively, on line 49—49 in FIG. 48, line 50—50 in FIG. 49 and line 51—51 in FIG. 50.
Figure 50:
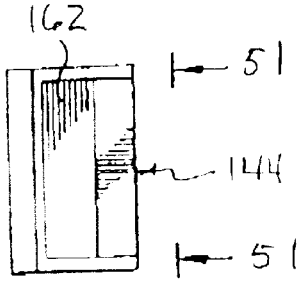
Figure 48:
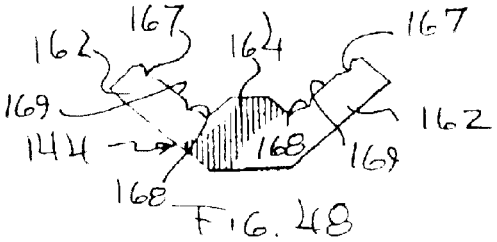
Figure 51:
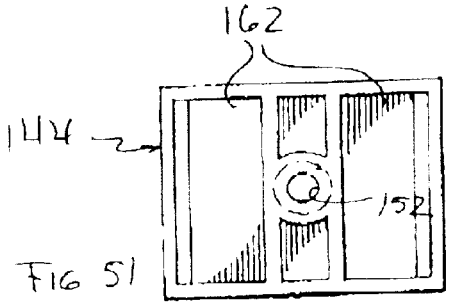

Turning now to FIGS. 42 and 43, a system embodying the invention, and serving to mount a pair of workpieces W in a right-angular relationship to one another, is depicted. The system consists of a pair of C-clamps 10 joined by a miter connector assembly embodying the invention. The connector assembly consists of an exterior block, an interior block, and a handle, generally designated by the numerals 142, 144, and 146, respectively, assembled in a manner comparable to the components of the straight-line connector assembly hereinabove described. More specifically, the head of a square-headed bolt 147 is engaged in the square recess 148 formed into the outer surface of the block 142, with the shank of the bolt extending through passages 150 and 152 in the exterior block 142 and interior block 144, and then through a passage (not shown) in the handle 146 to threadably engage a nut 154 seated in the square recess 146. A coil spring (also not shown) is operatively interposed between the blocks 142, 144 to urge them apart.

As best seen in FIGS. 44 through 47, the exterior block 142 comprises a body 158 of generally V-shaped cross section, with a pair of laterally aligned rectangular lugs 160 projecting from the apex. The surfaces 170, defining the sides of the body 158, are disposed at an angle of 270° to one another; as can be seen, they are flat and unconfigured.

The interior block 144 consists of panels or wings 162 disposed at a 90° angle to one another and affording a generally V-shaped cross section to the component (because of the thickened central portion 164 at the intersection of the panels 162, however, the block 144 might be characterized as having W-shaped cross section). A pair of parallel recess formations 167, 168 extend laterally across the face 169 of each panel portion 162, and two aligned sockets 172 extend into the central portion 164 for receipt (in key-like fashion) of the lugs 160 on the exterior component 142.

As is best seen in FIG. 42, the engagement portions of the C-clamps 10 are received in the spaces formed by the confronting surfaces 169, 170 of the interior and exterior blocks 144, 142 of the angle connector assembly. The edges of the fillets 18 and the rib elements 20 are seated in the recess formations 168 and 167 of the interior block, and of course the surfaces 170 of the exterior block bear upon the opposite sides of the engagement portions. The workpieces W are in turn secured by the C-clamps in right-angular relationship, as shown. It will be appreciated that a miter connector assembly embodying the invention can be constructed in like manner to dispose members at virtually any relative angle, albeit for practical reasons angles in the range 30° to 150° will be typical.

FIGS. 52 and 53 depict an alternative form of bar clamp 12' embodying the invention, wherein the engagement portions of the jaws 30', 32' are of T-shaped cross section rather than having the pattern of raised rib structures depicted in FIGS. 22 and 23. This construction is similar to that which is utilized for the components of the pipe clamp through 56 described in reference to FIGS. 37 through 41, and serves similar purposes; i.e., the foot element 140 of each engagement portion is engaged in a through passage defined by the channels 56.

FIGS. 54 through 56 depict an alternative arrangement of projecting and seating elements suitable for use in the tools and connector assemblies of the invention. The engagement portion of the C-clamp, shown in FIGS. 54 and 55 and generally designated by the numeral 10', has a peripheral flange or fillet 18 extending thereabout but is formed with elongate recess formations 180 on its opposite sides, rather than having upstanding rib structures. The exterior and interior blocks, generally designated respectively by the numerals 173 and 174, both have raised rib structures 176 extending laterally along a margin of the connector assembly, together with recess formations 178 which extend therealong in parallel relationship. As will be self evident, the edges of the clamp flange 18 seat in the recess formations 178 on the confronting faces of blocks 172 and 174, while the projecting rib structures 176 of the blocks seat in the recess formations 180.

Turning now to FIGS. 57–65 of the drawings, therein illustrated in detail is a bar clamp embodying the invention. The clamp consists of a fixed jaw and a movable jaw, generally designated by the numerals 182 and 184 respectively, the jaw 182 being affixed to the end of the bar 28, which is slidably received in the passage 188 of the movable jaw housing. The jaws have flanges 181 and 183 bearing raised rib structures and providing engagement portions, as previously described, and protective plastic sleeves 186 are mounted on the jaws over their confronting contact surfaces.

A clamping arm, generally designated by the numeral 190, is received in the space 192 defined between the walls 194 of the housing of which the movable jaw 184 is comprised. The arm 190 has a threaded aperture 196 at its upper end, to receive the clamping screw 198, and a contact disc 200 is rotatably mounted on the stud 201 that projects from the tip of the screw 198. An oblong passage 202 extends through the lower end of the arm 190, and a hooked nose portion 204 projects forwardly therefrom between the aperture 196 and the passage 202. An oblong coil spring 206 is slidably mounted between the arm 190 and the back wall 208 of the jaw housing.

In operation, the movable jaw of the bar clamp is moved forwardly on the bar 28 until it contacts (or substantially contacts) the workpiece W. When used in vertical orientation, the movable jaw can be permitted to simply slide into contact with the workpiece, under the force of gravity, then requiring only limited rotation of the handle to effect clamping. The nose portion 204 is positioned to contact the bar 28 when the arm 190 is canted forwardly, thereby preventing engagement by the surface defining the passage 202 and hence ensuring that such free descent occurs.

Conversely, the coil spring 206 (acting against the wall 208) exerts a force~upon the lower portion of the arm 190, canting it rearwardly so as to cause the surface defining the upper part of the passage 202 to engage and bind upon the confronting edge of the bar 28. This presents the arm from moving backwardly along the bar (unless the biasing force is relieved), and ensures that the movable jaw will advance against the work to provide that clamping force desired.

As will be appreciated, the system of the invention enables support of various forms of clamps and, in turn, workpieces, in a wide variety of combinations and configurations for a multitude of applications. In many instances a C-clamp will be employed either to grip a workpiece directly (e.g., frame pieces in a miter relationship) or by engagement of a second clamp (e.g., another C-clamp, a bar clamp, a pipe clamp) to hold the secondary clamp in position for mounting a workipiece. A standoff device may be clamped in position by a connector assembly or, as mentioned above, it may be used simply to provide support for the bar or pipe of a bar clamp or pipe clamp, and/or for a workpiece, and the brackets described may be fastened directly to a support surface or secured temporarily by a C-clamp. As will be appreciated, the systems of the invention may serve many purposes including, for example, use as a vise for holding workpieces in position, use as a multiple-effect clamping arrangement, use as a mount for a camera or the like, etc., and numerous additional applications will undoubtedly occur to those skilled in the art.

Thus, it can be seen that the present invention provides a system in which tools of various kinds can be mounted and interengaged in positive, selected positions and relationships, as well as providing novel tools and connector assemblies comprising such a system. The system and components are of relatively incomplex design and construction, and of relatively facile and inexpensive manufacture.

Having thus described the invention, what is claimed is:

1. A tool and connector system comprised of at least one clamping tool and a connector assembly; said clamping tool having a generally planar engagement portion with a laterally extending outer edge and having, on at least one of two opposite side surfaces thereof, at least two mutually parallel and transversely spaced, laterally extending raised rib structures; said connector assembly including a pair of clamping blocks and means for coupling said blocks in mutually confronting operative relationship and for urging them toward one another, an inner face of one of said blocks being formed with a first set of at least two transversely spaced, laterally extending recess formations proximate a first outer edge of said connector assembly and dimensioned and configured for seating said rib structures on said engagement portion of said clamping tool, whereby said clamping blocks of said connector assembly can be tightened upon said engagement portion of said clamping tool, with said rib structures seated in said recess formations, to securely mount said clamping tool in a positive selected relationship to said connector assembly.

2. The system of claim 1 wherein each of said rib structures and recess formations is substantially free from discontinuity along the length thereof, and wherein said recess formations extend fully across said inner face of said one block.

3. The system of claim 1 wherein said engagement portion of said clamping tool also has said raised rib formations on the other of said opposite side surfaces.

4. The system of claim 3 wherein said rib formations on said one side surface of said engagement portion align, through the thickness of said engagement portion, with said rib formations on said other side surface thereof.

5. The system of claim 1 wherein said engagement portion of said clamping tool has an inner edge, and wherein one of said rib structures extends along said outer edge and another of said rib formations extends along said inner edge.

6. The system of claim 1 wherein said engagement portion of said clamping tool has an inner edge, and wherein one of said rib structures extends along said outer edge and another of said rib structures is disposed intermediate said inner and outer edges.

7. The system of claim 6 wherein said clamping tool is a C-clamp comprised of two cooperating jaw portions spaced along the length of a back portion, and wherein said engagement portion of said tool comprises at least one of said back and said jaw portions of said C-clamp.

8. The system of claim 1 wherein clamping tool is a bar clamp having two jaws, and wherein said engagement portion comprises a flange on at least one of said jaws of said bar clamp.

9. The system of claim 1 wherein said clamping tool is a one-piece coupling device; wherein said engagement portion comprises a flange on said coupling device, and wherein said coupling device includes a head portion integrally formed with said engagement portion and constructed for the snap-fit clamping engagement of a separate member mounted thereon.

10. The system of claim 1 wherein an inner face of the other of said pair of clamping blocks has laterally extending raised rib structure thereon, said rib structure on said other block being aligned intermediate said at least two recess formations of said one block when said pair of blocks are disposed in an operative relative orientation.

11. The system of claim 1 wherein said inner face of one of said pair of clamping blocks is formed with at least a second said set of recess formations proximate a second outer edge of said connector assembly.

12. The system of claim 11 wherein said second outer edge of said assembly lies opposite to said first outer edge, and wherein said means for coupling said blocks and for urging them toward one another acts to apply force on an axis between said first and second outer edges.

13. The system of claim 11 wherein said second outer edge of said assembly lies adjacent to said first outer edge.

14. The system of claim 11 including a second said tool having a said generally planar engagement portion thereon, said second tool being so mounted with said rib structures of said engagement portion thereof seated in said second set of recess formations.

15. The system of claim 1 wherein the inner face of each of said pair of clamping blocks is formed with a channel extending laterally filly thereacross proximate a second outer edge of said connector assembly, said channels being aligned with one another in an operative relative orientation of said clamping blocks to cooperatively form a passage through said connector assembly proximate said second outer edge thereof.

16. The system of claim 1 wherein said connector assembly additionally includes means for constraining said clamping blocks to a single operative relative orientation, and means for biasing said blocks away from one another.

17. The system of claim 1 wherein said blocks are of substantially the same size and are of generally planar, rectangular construction.

18. The system of claim 1 wherein said one block is of generally V-shaped cross section and is comprised of two portions disposed at an angle of about 30° to 150° to one another, wherein said first outer edge is on one of said portions, and wherein the other of said pair of clamping blocks has a mating, generally V-shaped cross section generally complementary to that of said one block.

19. The system of claim 18 wherein said angle is 90°.

20. A tool and connector system comprised of at least one tool having a generally planar engagement portion with opposite side surfaces and a laterally extending outer edge; and a connector assembly including a pair of clamping blocks and means for coupling said blocks in mutually confronting operative relationship and for urging them toward one another, said connector assembly being constructed for receiving said engagement portion of said at least one tool there-between and for gripping said engagement portion with the inner surface of each of said blocks bearing upon the confronting side surface of said engagement portion to provide a contact surface pair therewith, said confronting surfaces comprising at least one of said contact surface pairs having first orientation constraint means thereon comprised a recess formation, and protruding structure seated in said recess formation for constraining said tool and said connector assembly against relative angular movement, whereby said tool can be mounted securely on said connector assembly in a positive, selected relationships thereto.

21. The system of claim 20 wherein said recess formation and said protruding structure also extend generally laterally.

22. The clamp system of claim 20 wherein said recess formation is on said inner surface of said connector assembly block and said protruding structure is on said confronting side surface of said engagement portion of said tool.

23. The clamp system of claim 22 wherein said protruding structure is rib structure.

24. The clamp assembly of claim 23 wherein said outer edge of said engagement portion is generally rectilinear and said rib structure is substantially parallel thereto.

25. The clamp assembly of claim 20 additionally including second said orientation constraint means.

26. The clamp assembly of claim 25 wherein said first and second orientation constraint means also extend generally laterally and are mutually parallel.

27. The clamp assembly of claim 26 wherein said first and second orientation constraint means are transversely spaced from one another in reference to said engagement portion outer edge.

28. The clamp assembly of claim 25 wherein said second orientation constraint means is on said at least one of said contact surface pairs.

29. The clamp assembly of claim 25 wherein said second orientation constraint means is on the other of said contact surface pairs.

30. The clamp assembly of claim 25 additionally including third said orientation constraint means.

31. The clamp assembly of claim 20 wherein said at least one tool is a clamping tool.

32. A connector assembly for use with a clamping tool in a clamp system, said connector assembly including a pair of clamping blocks and means for coupling said blocks in mutually confronting operative relationship and for urging them toward one another, an inner face of one of said blocks being formed with a first set of at least two transversely spaced, laterally extending recess formations proximate a first outer edge of said connector assembly and dimensioned and configured for seating rib structures, and an inner face of the other of said pair of clamping blocks having laterally extending raised rib structure thereon, said rib structure on said other block being aligned intermediate said at least two recess formations of said one block when said pair of blocks are disposed in an operative relative orientation, whereby said clamping blocks of said connector assembly can be tightened upon an engagement portion of a clamping tool inserted therebetween, with rib structures on the engagement portion seated in said recess formations, to securely mount such a clamping tool in a precise position relative to said connector assembly.

33. The connector assembly of claim 32 wherein said inner face of one of said pair of clamping blocks is formed with at least a second said set of recess formations proximate a second outer edge of said connector assembly.

34. The connector assembly of claim 33 wherein said second outer edge of said assembly lies opposite to said first outer edge.

35. The connector assembly of claim 33 wherein said second outer edge of said assembly lies adjacent to said first outer edge.

36. The connector assembly of claim 32 wherein the inner face of each of said pair of clamping blocks is formed with a channel extending laterally fully thereacross proximate a second outer edge of said connector assembly, said channels registering with one another in an operative relative orientation, of said clamping blocks to cooperatively form a passage through said connector assembly proximate said second outer edge thereof.

37. The connector assembly of claim 32 wherein said connector assembly additionally includes means for constraining said clamping blocks to a single operative relative orientation.

38. The connector assembly of claim 32 wherein said blocks are of substantially the same size and are of generally planar, rectangular construction.

39. The connector assembly of claim 32 wherein said one block is of generally V-shaped cross section and is comprised of two portions disposed at an angle of about 30° to 150° to one another, wherein said first outer edge is on one of said portions, and wherein the other of said pair of clamping blocks has a mating, generally V-shaped cross section generally complementary to that of said one block.

40. The connector assembly of claim 39 wherein said angle is 90°.

41. The connector assembly of claim 39 wherein the inner face of the portion of said other block, confronting said recess formations, is substantially flat.

* * * * *